United States Patent [19]-

Nolte

[11] Patent Number: 5,000,671

[45] Date of Patent: Mar. 19, 1991

[54] MACHINE FOR IMPRINTING SCULPTURED DESIGNS ON WALLS AND CEILINGS

[76] Inventor: Ray J. Nolte, 2403 Telegraph Rd., St. Louis, Mo. 63125

[21] Appl. No.: 430,833

[22] Filed: Oct. 20, 1989

[51] Int. Cl.[5] ..... B05D 5/00; B05C 17/02

[52] U.S. Cl. ..... 425/231; 134/68; 15/210.5; 15/230.11; 29/121.1; 425/385

[58] Field of Search ..... 29/121.1, 121.2, 110.5; 425/231, 232, 225, 230, 249, 385; 401/208; 134/138, 153, 68; 52/311; 15/248 A, 230.11, 24

[56] References Cited

U.S. PATENT DOCUMENTS

| | | | |
|---|---|---|---|
| 2,485,428 | 10/1949 | Bleier | 29/121.2 X |
| 3,748,678 | 7/1973 | Ballou | 401/208 |
| 4,201,801 | 5/1980 | Hori | 29/121.1 |
| 4,257,140 | 3/1981 | Downing | 29/110.5 |
| 4,510,729 | 4/1985 | Syring | 52/311 |
| 4,667,363 | 5/1987 | Calvert | 134/138 |

*Primary Examiner*—Richard J. Johnson

[57] ABSTRACT

A hand held, self cleaning, machine which uses embossed design rollers to sculpture designs on walls or ceilings. It is now possible to put embossed designs on walls or ceilings, in prepared areas of mortar, joint compound, clay, or cement. The machine uses a water jet spray to continuously clean the design roll and vacuum to continuously remove the contaminated water.

3 Claims, 3 Drawing Sheets

MACHINE FOR IMPRINTING SCULPTURED DESIGNS ON WALLS AND CEILINGS

BACKGROUND

1. Field of Invention

This invention is a hand held apparatus which uses embossed design rollers to sculpture those designs in preapplied dry wall compound or other suitable material on ceilings or walls. It is self cleaning in that the design rollers are continuously cleaned with jets of water over the length of the roller. The water is drawn off by vacuum using a standard shop type vacuum.

BACKGROUND

2. Description Of Prior Art

A preliminary search has shown no prior art in devices to apply sculptured designs to interior walls or ceilings, or to exterior walls.

Wall printing, developed in Germany in the 1940s, is the business from which the idea for a machine to sculpture permanent designs on ceilings and walls was conceived. Wallprinting is the process of using an applicator which applies the proper amount of latex paint to the applicator's embossed design roller to simulate wallpaper as it is rolled vertically down the wall.

The embossed design rollers used for sculpturing are purchased from German and Italian wall printing equipment manufacturers. In none of their catalogs has an advertisement for any type of sculpturing equipment been seen.

OBJECTS AND ADVANTAGES

The object of the invention is developement of a self cleaning, hand held machine capable of sculpturing walls and ceilings, or any specific area of wall or ceiling, with any design of choice.

The advantage of this invention is that it is innovative and time saving. At present any sculpturing on walls or ceilings is done only by hand by skilled artists.

Figure 1:
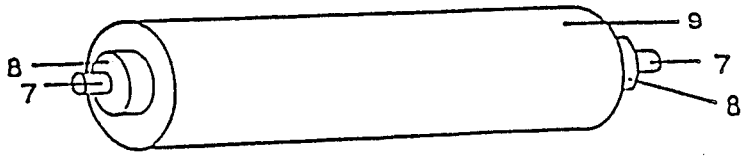
FIG. 1. The roller core.

Reference Numerals in Drawings:

6. Design cover
6A. Design roller assembly
7. Axle (of core)
8. Flange (of core)
9. Roller core
10. Circular spacer
11. Side (right and left)
12. Notch
13. Foam rubber collar
14. Jet spray assembly
15. Center water barrier
16. Housing bottom
17. Quarter circle cutouts
18. Barrier extension
19. Left vacuum spout
20. Center vacuum spout
21. Right vacuum spout
22. Vacuum spout cap
23. Round head brass screws
24. Front water deflector
25. Self tapping screws
26. Foam rubber pivot strip
27. Housing front
28. Housing back
29. Back water deflector
30. Spray asm. locating hole
31. Handle (right and left)
32. Half circle cutouts
33. Roller core/extended axle
35. Axle extension
36. Axle of roller core for cir.
37. Rubber tired wheel
38. Wheel axle clamp
40. Circle clamping pivot
41. Clamping pivot handle
42. Axle extension coupling

DESCRIPTION

FIG. 1 shows the roller core 9 without the design cover. It is made of plastic or other suitable stable waterproof material. The large flange 8 at each end of the roller fits into a depression in the foam rubber collar 13 FIGS. 3, 4. Collar 13, has a thickness equal to the length of flange 8 FIG. 1. The collar is securly glued to the upper portion of the inner side of each housing side 11 FIGS. 3, 4, 8. The purpose of collar 13 is to contain the water used to clean the design cover 6 FIG. 2 which fits over core 9. The lower part of foam rubber collar 13 touches the upper end of housing front 27 FIG. 4 and housing back 28 FIG. 5. The axle 7 at each end of the roller core 9 snaps into notch 12 of FIGS. 3, 4. This permits switching from one design roller to another in a matter of seconds.

For ease in description and understanding, no distinction will be made between flange 8 or axle 7 as being left or right in FIG. 1 as both sides of core 9 are identical. The same is true for side 11, notch 12, foam rubber collar 13 FIGS. 3, 4, as well as left and right handle 31 FIGS. 7, 8. In each case the part on the left side is identical to the part on the right side and has an identical number.

Figure 2:
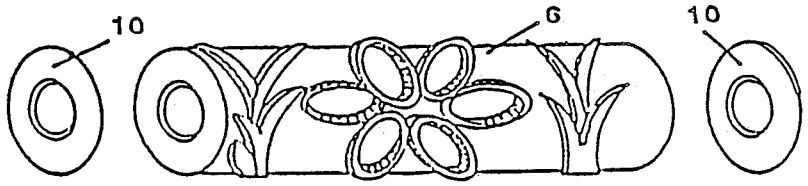
FIG. 2. The roller cover.

FIG. 2 shows the flexible standard wall printing roller design cover 6. After the design cover 6 FIG. 2 has been placed over roller core 9 FIG. 1, the circular spacer 10 FIG. 2 is placed over each flange 8 FIG. 1. The purpose of said spacer is to prevent friction between the turning roller design cover 6 and the foam rubber collar 13 FIGS. 3, 4. For clarity, roller design cover 6, now installed over core 9, will together be referenced as design roller 6A (assembly) meaning the roller core 9, including both flanges 8 and both axles 7, and design cover 6 combination.

Figure 3:
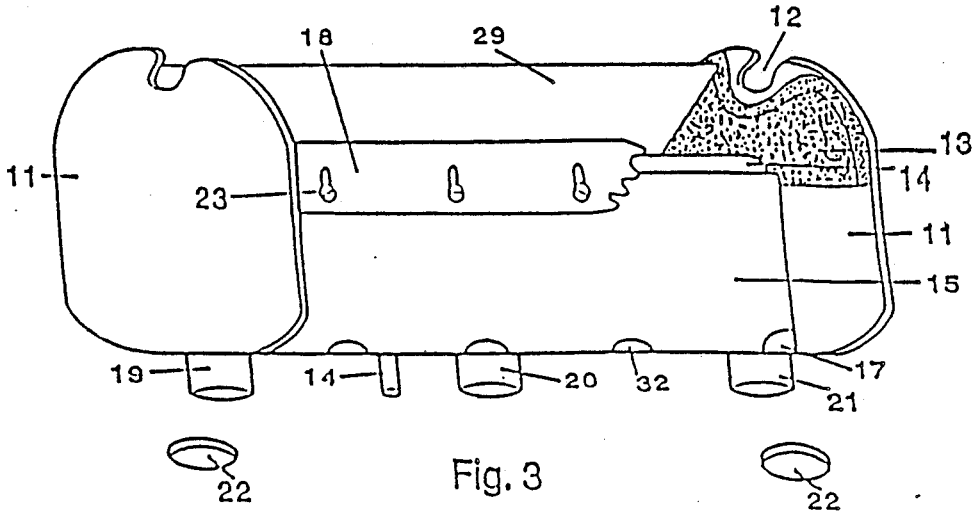
FIG. 3. Front view with housing front removed.
Figure 4:
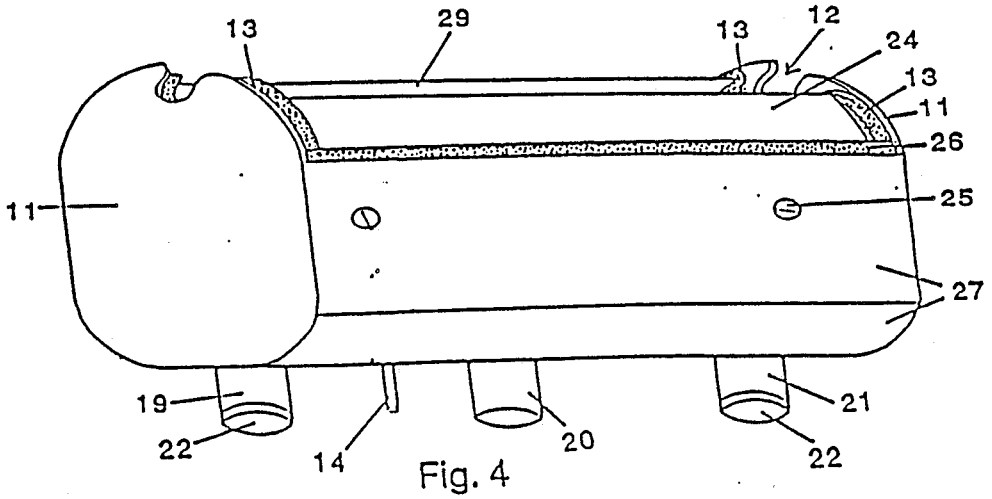
FIG. 4. The front view.
Figure 5:
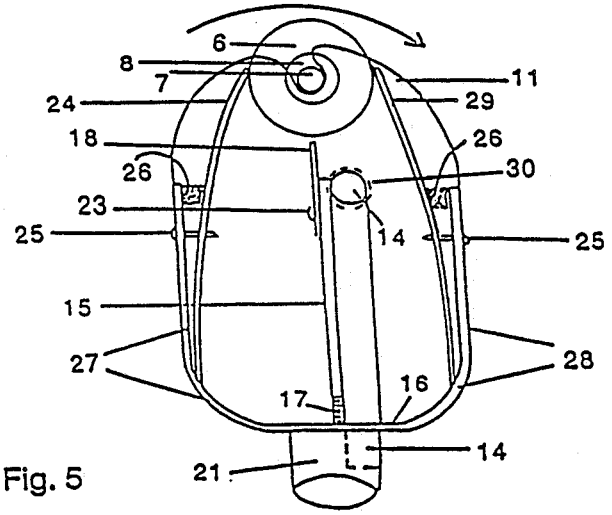
FIG. 5. A visual side view.

FIG. 3 shows an angle view of the housing with housing front 27 FIGS. 4, 5, and front water deflector 24 FIG. 4, 5, removed. Sides 11 of flexible plastic show the notch 12 that the roller axle 7 FIG. 1 snaps into. The notch is so designed that as the design roller 6A is being moved across wall or ceiling, the heavy portion of the notch material in side 11 is holding the roller in. It cannot fall out in usage. T shaped water jet spray assembly 14 FIGS. 3, 5, 8, continuously cleans the design roller 6A with a line of closely spaced jets of water (under adjustable pressure) from end to end. Said assembly 14 is held in hole 30 FIG. 5 in each side 11 adjoining barrier 15. The assembly 14 is made of copper tubing or other suitable material and positioned so that the water jet holes on top are sufficiently below the bottom of the inserted design roller and angled so that the water jets lift all particles of sculpture material (usually dry wall joint compound) from the moving design roller. Handle 31 FIGS. 7, 8, permanently fastened to the exterior of each side 11 seals hole 30 FIG. 5 against water leakage and any side movement of T shaped water spray assembly 14. The vertical leg of T shaped water assembly 14 protrudes through the housing bottom 16 FIG. 5. Adjustable water pressure in said T assembly 14 is provided by a water hose and valve (not shown) attached to the lower end of the T assembly.

Figure 8:
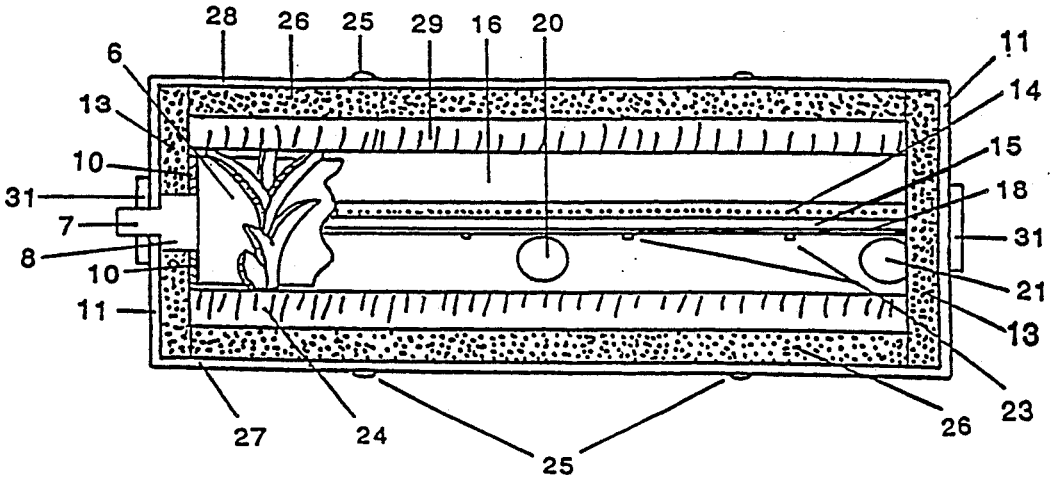
FIG. 8. A visual top view.

Center barrier 15 FIGS. 3, 5, 8, keeps the water jets on the cleansing side of the housing assembly from being affected by the vacuum action on the other side of barrier 15. Said barrier 15 is fastened vertically to the center of each housing side 11. FIGS. 3, 8, and to the center of housing bottom 16 FIG. 5. Barrier 15 has two quarter circle cutouts 17 FIGS. 3, 5, having 20 millimeter radius. One quarter circle cutout is centered at the joining point of barrier 15 with each housing side 11 and housing bottom 16. Said barrier 15 also has three half circle cutouts 32 FIG. 3 of 15 millimeter radius located at its connection with bottom 16 FIG. 5. One cutout is in the center of the barrier 15 length, and the other two are spaced midway between the center cutout and the end cutouts 17 FIGS. 3, 5. These cutouts permit the water jet spray that drips off the design roller 6A on the spray side of the center barrier 15 to be drawn through these cutouts and disposed of by the shop vacuum hose attached to spout 20 FIGS. 3, 4. Barrier extension 18 FIGS. 3, 8 is a thin plastic shield whose length is equal to the combined length of design cover 6 FIG. 2 and the two circular spacers 10 FIG. 2. Barrier extension 18 is fastened to the upper portion of barrier 15 so that its top edge is approximately 4 millimeters below the inserted design roller 6A. Being an upward extension of the barrier 15, it serves the same purpose, to prevent the vacuum action from affecting the cleaning action of the water jets. Barrier extension 18 is fastened to barrier 15 with four brass round head screws 23 FIGS. 3, 8 and is adjustable vertically with slotted screw holes.

The left side of FIG. 8, a cutaway top view, reveals the relationship between the inserted design roller assembly 6A, circular spacer 10, flange 8, axle 7, side 11, foam collar 13, front water deflector 24, and back water deflector 29.

Figure 7:
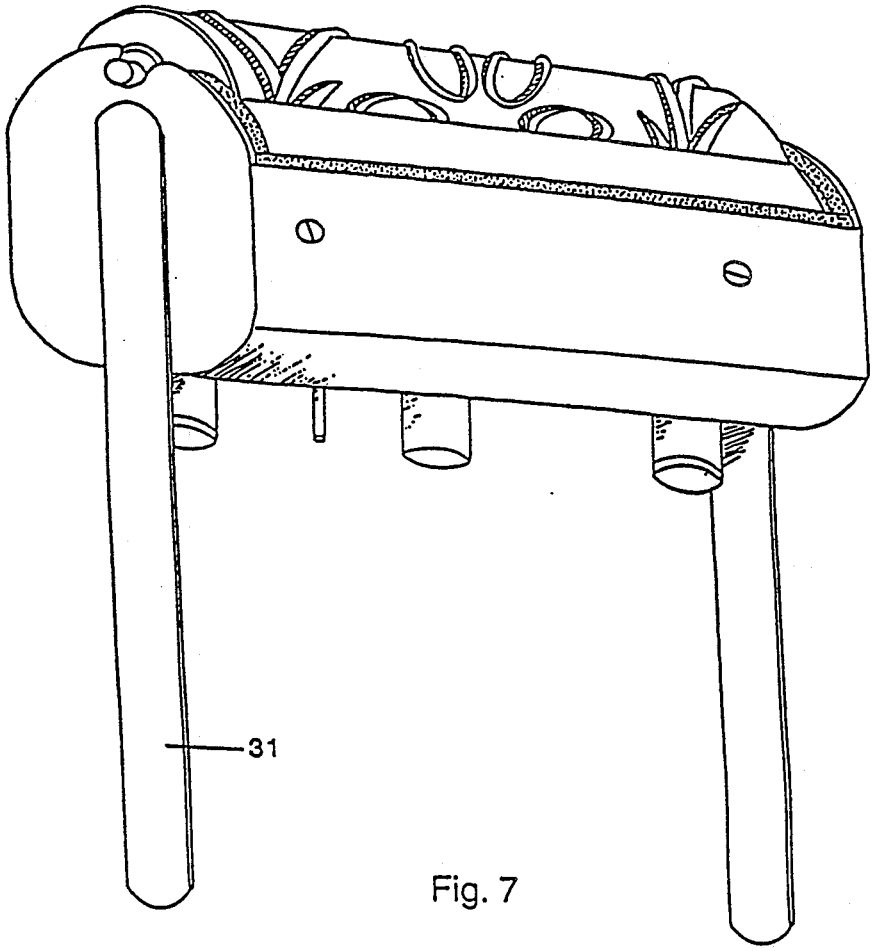
FIG. 7. Front Perspective.

When a person is sculpturing ceilings, operation is performed by gripping right and left handle 31 FIGS. 7, 8, and rolling design roller 6A across the prepared surface, in his direction, while facing front 27 FIGS. 4, 5, 8. In sculpturing a prepared ceiling border, he would be walking backward while rolling design roller 6A toward himself. He would be facing the assembly as it is shown in FIGS. 4 and 7.

Vacuum spout 20 FIG. 3 is normally used when applying sculptured designs on ceilings and vertical designs on walls. At these times vacuum spouts 19 and 21 FIGS. 3, 4 are each capped with snug fitting cap 22 FIGS. 3, 4. When sculpturing a wall design horizontally from left to right, the vacuum hose is attached to vacuum spout 21 FIGS. 3, 4, and spouts 19 and 20 are each capped using cap 22. When sculpturing a wall design horizontally from right to left, the vacuum hose is attached to vacuum spout 19 and spouts 20 and 21 are each capped. These changes of the vacuum hose are necessary to eliminate the possibility of water leakage in horizontal sculpturing as the water naturally falls to the lower housing side 11 and the vacuum hose must be placed at that lower position.

FIG. 4 is a front view of the self cleaning sculpturing machine with the design roller 6A removed. Front water deflector 24 FIG. 4 is a piece of 2 millimeter flexible plastic with a length equal to the combined length of design cover 6 FIG. 2 and the two circular spacers 10 FIG. 2. Its width, top to bottom, is 75 mm. and its purpose is to keep the cleansing water within the machine. Its top edge is 4 millmeters above the center line of the installed design roller 6A. This provides maximum design roller 6A exposure. Front water deflector 24 is pivoted into contact with the design roller 6A through use of front foam rubber pivot strip 26 FIGS. 4, 5, 8. Said pivot strip is 15 millimeters square and extends from the left side to the right side of the housing. It is cemented to the inside of housing front 27 even with the top edge of front 27. Its ends abut each housing side 11, and contact each foam collar 13 at the collar's bottom end. Front water deflector 24 pivots on pivot strip 26 through adjustment of two self taping adjusting screws 25 FIG. 4. These screws, 25 mm. long, are placed through holes in housing front 27. These holes are located 30 mm. below the top edge of housing front 27 and 50 mm. from either housing side 11. The self taping screws 25 making intrusion into the lower part of front water deflector 24, are used to adjust the pivotal action of deflector 24 so that the top edge of the deflector contacts design roller 6A just above the roller's midpoint.

FIG. 5, a visual drawing of the right side view of the housing assembly, shows the relationship of right housing side 11, design roller cover 6 (over core 9), flange 8, axle 7, T shaped water jet spray assembly 14, hole 30, center barrier 15, barrier extension 18, housing bottom 16, vacuum spout 21, front 27, back 28, front water deflector 24, back water deflector 29, front and back pivot strips 26, and front and back adjusting screws 25.

From FIG. 5 it can be noted that housing back 28 is identical to housing front 27, back water deflector 29 is identical to front water deflector 24, front and back pivot strips 26 are identical, and front and back adjusting screws 25 are identical.

Still considering visual right side view FIG. 5, the curved arrow above design cover 6 indicates the direction in which the design roller always turns. After putting the sculptured impression into the dry wall compound, cement, clay, mortar or other material, the design roller enters the cleansing water jet spray enclosure area formed by back extension 29, housing back 28, the back half of bottom 16, the back half of both housing sides 11, center barrier 15, and barrier extension 18. The design roller is thoroughly cleaned of adhering material and, as it passes barrier extension 18, it enters the vacuum enclosure where it is vacuum cleaned of all water and material particles. The vacuum enclosure is formed by housing front 27, front water deflector 24, the front half of housing bottom 16, the front half of both housing sides 11, center barrier 15, and barrier extension 18.

Figure 6:
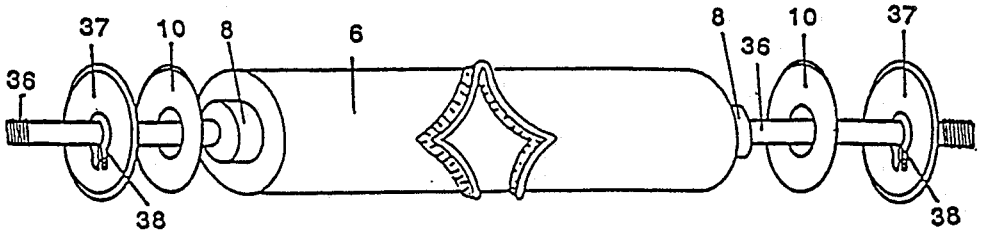
FIG. 6. Sculpturing with unbalanced design roller.

FIG. 6 depicts the mechanism for sculpturing designs that do not circumvent the design roll and therefore will not roll freely. The design shown in FIG. 6 is such a design. It requires a rubber tired wheel 37 to be attached to each axle 36. This is accomplished by use of wheel axle clamp 38 which is a physical part of the rubber tired wheel.

This mechanism uses core 33 (not shown) which is covered by a design cover 6. Core 33 is identical in size to core 9 FIG. 1. Its flanges 8 are identical to those of core 9, but has axles 36 which are the the same diameter as those of axle 7 FIG. 1 but are considerably longer and are threaded on each end. In use, a circular spacer 10 is slid over each flange 8 and the assembly, with axles 36, is snapped into notch 12 FIGS. 3, 4 of each housing side. A rubber tired wheel 37 is then clamped onto each axle 36 where it extends beyond the housing side 11.

The wheels permit a design such as that shown in FIG. 6 to be sculptured in ceiling borders, etc. The wheels are positioned on the axle in such manner that they do not track through the area prepared for sculpturing. This mechanism, designed for borders is not applicable to sculpturing of wide areas.

Figure 6A:
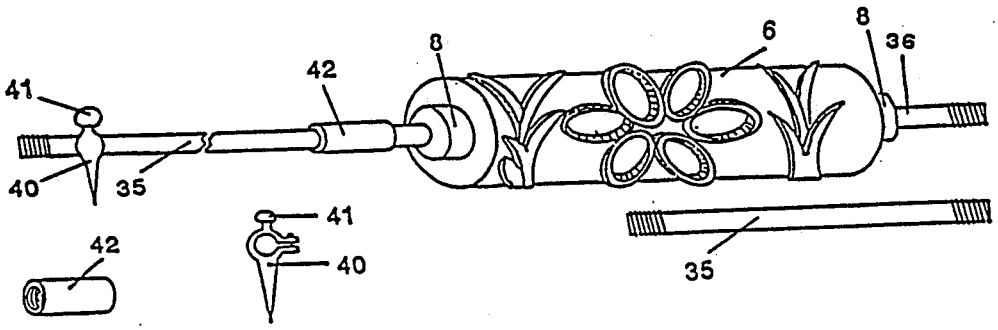
FIG. 6A. Circular sculpturing mechanism.

FIG. 6A is a mechanism used for sculpturing circles when snapped into the machine. Design cover 6 over core 33, with flanges 8, circular spacers 10, and axles 36 is snapped into the machine. With the design shown, the rubber tired wheels are not used. Using couplings 42 and axle extensions 35, one axle is extended to a length greater than the radius of the circle. Circle clamping pivot 40 is fastened to the axle extension to provide the proper radius for the sculptured design. Clamping pivot handle 41, which rotates freely on the clamping pivot, is held by a second party as the sculptured design is rolled into the prepared circular area.

I claim:

1. A mechanism, using embossed designs on rollers, to produce sculptured designs on areas of walls, ceilings or floors which have been prepared with a layer of joint compound, plaster, clay, or cement, wherein the embossed design roller is continuously cleaned by a multiplicity of water jets, the mechanism comprising:

A. a design roller cover mounted over a roller with an axle on either end mounted in said housing designed to permit free rotative movement of the design cover and roller combination;

B. a water dispensing assembly, within and extending across the housing, having a multiplicity of tiny holes to provide water jets to thoroughly clean the design roller during use;

C. a vacuum spout secured to said housing to permit drawing off the contaminated water during use;

D. a center barrier within the housing to separate the water jet cleansing area from the vacuuming area;

E. a series of cutouts in the bottom of the center barrier to permit water in the bottom of the cleansing area to be drawn off by the vacuum;

F. front and back water deflectors extending adjacent the roller to keep the water contained within the housing during use;

G. handle means handle to permit easy rolling of the design roller over the prepared area.

2. A mechanism, using embossed designs on rollers, to produce circular sculptured designs on areas of walls, ceilings or floors which have been prepared with a layer of joint compound, plaster, clay, or cement, wherein the embossed design roller is continuously cleaned by a multiplicity of water jets, the mechanism comprising:

A. a design roller cover mounted over a roller having an extendable axle and a circular clamping pivot which is positioned on the axle and clamped to the axle to provide the proper circle radius;

B. a housing supporting the roller and provides free rotative movement of the roller;

C. a water dispensing assembly within an extending across the housing, having a multiplicity of tiny holes to provide water jets to thoroughly clean the design roller during use;

D. a vacuum spout secured to said housing to permit drawing off the contaminated water during use;

E. a center barrier within the housing to separate the water jet cleansing area from the vacuuming area;

F. a series of cutouts in the bottom of the center barrier to permit water in the bottom of the cleansing area to be drawn off by the vacuum;

G. front and back water deflectors extending adjacent the roller to keep the water contained within the housing during use;

H. handle means handle to permit easy rolling of the design roller over the prepared area.

3. A mechanism, using a roller having an embossed design, which partially surrounds the roller, to sculpture that design on a border area of a ceiling or wall, which has been prepared with a layer of joint compound, plaster, clay, or cement, the mechanism comprising:

A. a design roller cover having a design that tends to restrict free movement of the roller on the ceiling or wall;

B. a roller with an extended axle on either end for mounting in a housing designed to permit free movement of the roller;

C. a rubber tired wheel of slightly greater radius than the roller, clamped to either extended axle to permit free relative movement of the roller with the design for sculpturing said design in border areas of ceilings or walls;

D. a within the housing, having a multiplicity of tiny holes to provide water jets to thoroughly clean the design roller during use;

E. a vacuum spout secured to the housing to permit drawing off the contaminated water during use;

F. a center barrier within the housing to separate the water jet cleansing area from the vacuuming area;

G. a series of cutouts in the bottom of the center barrier to permit water in the bottom of the cleansing area to be drawn off by the vacuum;

H. front and back water deflectors extending adjacent the roller to keep the water contained within the housing during use;

I. handle means to permit easy rolling of the design roller over the prepared area.

* * * * *